US006447079B1

(12) United States Patent
Irwin

(10) Patent No.: US 6,447,079 B1
(45) Date of Patent: Sep. 10, 2002

(54) SHADOWBOXES AND SIMILAR MULTIPURPOSE STOWAGE CASES FOR HOBBYISTS

(76) Inventor: Russell S. Irwin, 6513 Venneman Ave., St. Louis, MO (US) 63122

( * ) Notice: Subject to any disclaimer, the term of this patent is extended or adjusted under 35 U.S.C. 154(b) by 0 days.

(21) Appl. No.: 09/694,299

(22) Filed: Oct. 23, 2000

(51) Int. Cl.[7] ..... A47F 3/14

(52) U.S. Cl. ..... 312/118; 312/138.1; 312/140; 40/661; 40/735; 40/737

(58) Field of Search ..... 312/117, 118, 312/138.1, 140, 348.3, 204, 245, 246, 100, 101, 102, 351; 40/661, 735, 771, 777, 779, 781, 737; 220/324, 848, 845, 843, 844, 507, 506, 528, 529, 533, 532, 551

(56) References Cited

U.S. PATENT DOCUMENTS

| | | | | | |
|---|---|---|---|---|---|
| 118,380 | A | * | 8/1871 | Monroe | 40/735 X |
| 2,099,046 | A | * | 11/1937 | Boston | 312/118 X |
| 2,385,603 | A | * | 9/1945 | Bloom | 312/118 X |
| 3,644,009 | A | * | 2/1972 | Tyler | 312/117 |
| 4,790,609 | A | * | 12/1988 | Guy | 312/117 |
| 4,884,689 | A | * | 12/1989 | Su-Chin | 220/532 X |
| 5,096,752 | A | * | 3/1992 | Wagner | 40/735 X |
| 5,190,127 | A | * | 3/1993 | Cummings | 40/536 X |
| 5,199,568 | A | * | 4/1993 | Streit et al. | 220/529 X |
| 5,375,352 | A | * | 12/1994 | Morris | 40/737 |
| 5,466,057 | A | * | 11/1995 | Blankenburg | 312/140 X |
| 6,167,680 | B1 | * | 1/2001 | Horn | 220/507 X |

FOREIGN PATENT DOCUMENTS

| | | | |
|---|---|---|---|
| GB | 2124007 | * | 2/1984 |
| GB | 2172548 | * | 9/1986 |

* cited by examiner

*Primary Examiner*—Lanna Mai
*Assistant Examiner*—Hanh V. Tran
(74) *Attorney, Agent, or Firm*—Norman L. Wilson, Jr.

(57) ABSTRACT

Shadowboxes traditionally have been used to show, and at the same time protect, hobbyist's items on display. The arrival of limited edition collectibles has led to a revival of the crafts of fabricating, not only shadowboxes, but other multiple compartment storage cases for use by hobbyists. Unfortunately the compartments in such cases cannot meet all of the size and shape requirements needed for various items now being collected. Such shadowboxes and stowage cases are not quite practical because they must be made to order. They also are not useable by artists and others desiring storage compartments that are not visible. Provided herein are multiple compartment storage cases that meet the stowage requirements for a wide variety of articles because they can be assembled by the user.

11 Claims, 8 Drawing Sheets

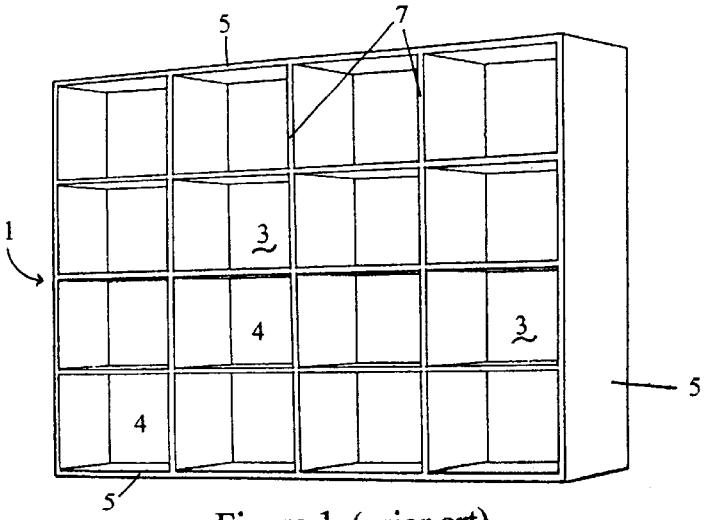
Figure 1 (prior art)
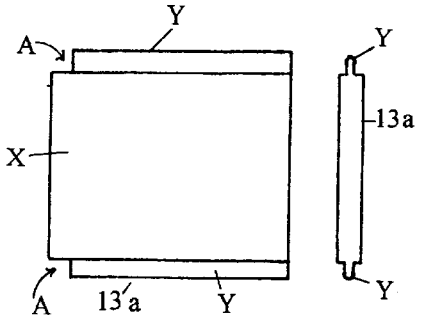
Figure 3
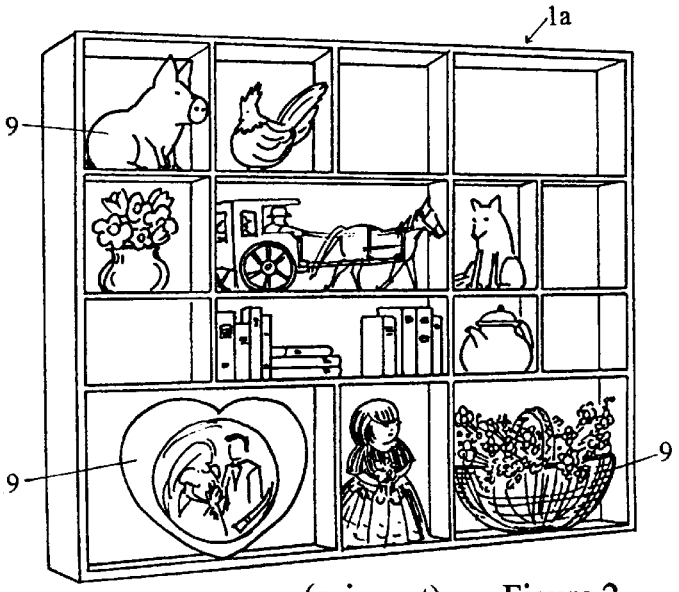
(prior art) Figure 2
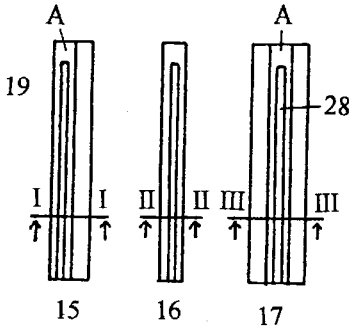
Figure 4
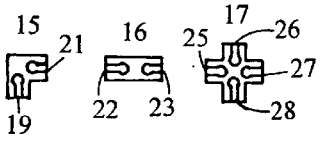
Figure 5

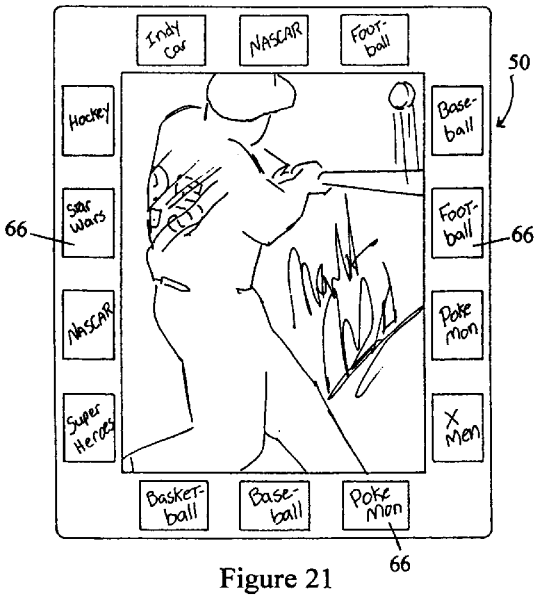
Figure 21
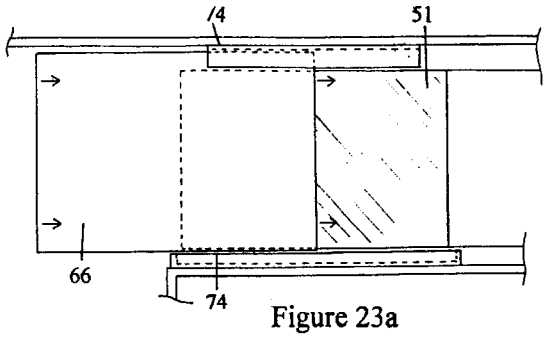
Figure 23a
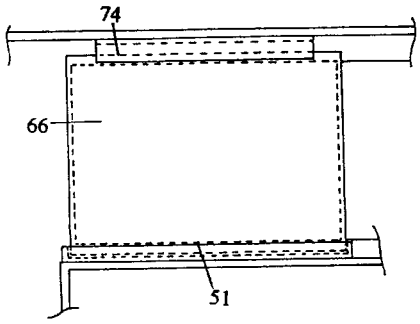
Figure 23b
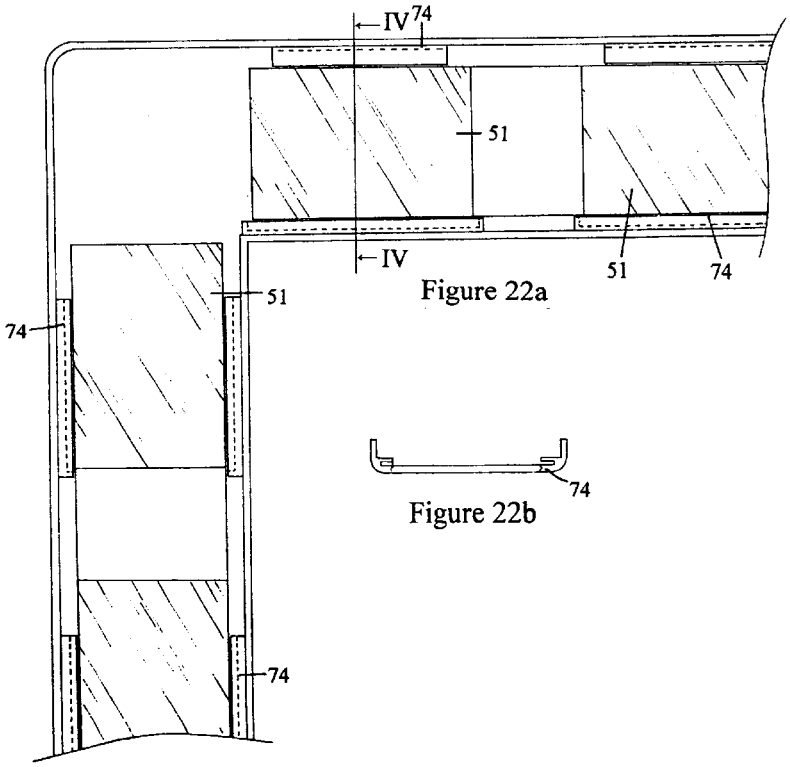
Figure 22a
Figure 22b
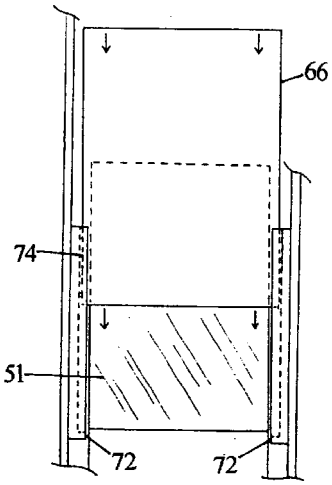
Figure 23c

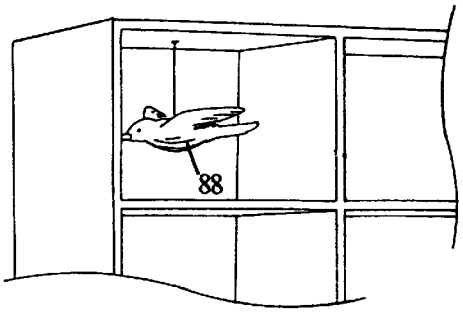
Figure 26
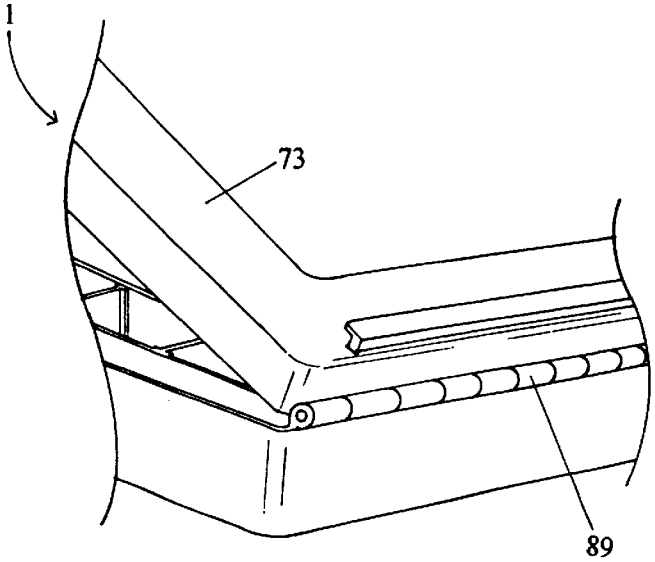
Figure 27
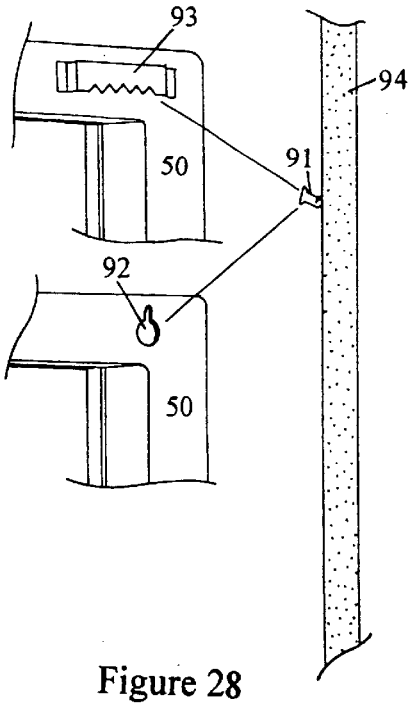
Figure 28
Figure 29a
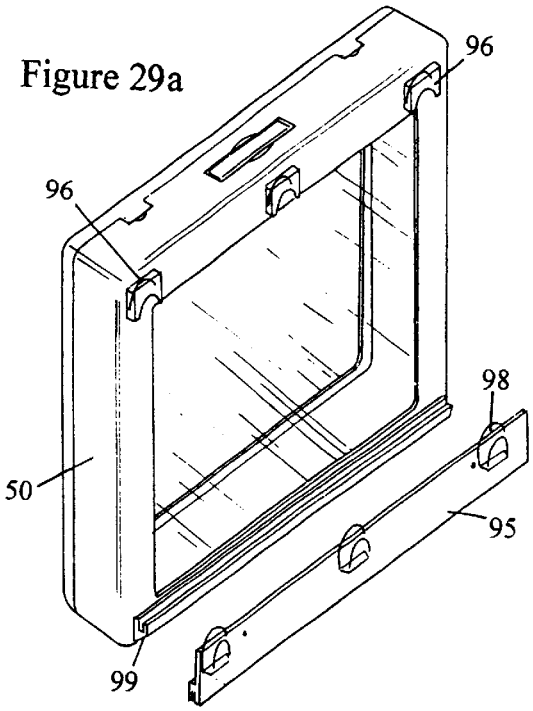
Figure 29b

SHADOWBOXES AND SIMILAR MULTIPURPOSE STOWAGE CASES FOR HOBBYISTS

BACKGROUND OF THE INVENTION

This invention, broadly, pertains to receptacles in the form of multipurpose stowage cases used in pursuit of various hobbies. In a more specific aspect the invention relates to multiple compartment storage cases for use by hobbyists. In a still more specific aspect, as a subset, the invention is directed to shadowboxes.

In recent years commercial promotions and special sales of limited editions of collectibles have led hobbyists across town in search of such newer items such as Beanie Babies, Pokemon articles, newer Barbie dolls, Ken dolls, and a new wave of basketball, football and baseball sports cards.

Shadowboxes traditionally have been used to show, and at the same time protect, hobbyist's items on display. For years they have housed such collectible items as miniature flags, trophies, awards, Precious Moment and Hummel ceramic dolls, and ceramic bells, as well as mementos purchased at estate sales, yard sales and flea markets. Examples of such collectibles are other ceramic figurines, souvenirs, badges, trophies, coins, jewelry and pictures.

Shadowboxes are shallow rectangular, generally wooden, frames, each having back and a transparent glass or plastic front. Within each frame a series of elongated wood strips divide the box into an array of compartments that house the collectibles. The art of the construction of shadowboxes can be said to have a rich heritage, so much so that improvements in the patent art are rare, being limited to a few design patents, such as U.S. Pat. No. Des. 390,364, and moldings therefor, such as that disclosed in U.S. Pat. No. 5,896,690. For years, then, the art of shadowbox making has continued in small shops of artisans supplying them. However, the arrival of limited edition collectibles has led to a revival of the crafts of fabricating, not only shadowboxes, but other multiple compartment storage cases for use by hobbyists, such as the display cases exemplified in U.S. Pat. No. 3,913,711 and U.S. Pat. No. 5,992,665.

A portable display case for displaying chips and swatches is the subject of U.S. Pat. No. 3,913,711. For convenience, two compartmented rectangular containers are provided that are adapted to be detachably connected for carrying or transporting the items they house. During use the two containers are separated and supported by their fold-back covers to display the items in the compartments.

In U.S. Pat. No. 5,992,665, a display case is described for displaying and transporting a plurality of collectibles. The case has a plurality of compartments that permit storage of the collectibles. In order to display the collectibles the case is provided with interlocking means permitting two or more adjacent cases to be assembled into a single unit. While larger arrays of units are possible, four cases, representing sixteen collectibles, are preferred. There are, thus, four compartments to the case.

It is to be understood that stowage cases such as those described are subject to certain disadvantages. Chief among them is the fact that the compartments cannot meet all of the size and shape requirements needed for various items being collected. The undesirable result is that shadowboxes and stowage cases must be made to order. It should be added that shadowboxes and the like are also not practical for use by artists and others desiring multiple compartment storage cases as will be illustrated hereinafter. Examples of items calling for differently sized multiple compartments in storage cases are artist's art supply cases, niniature autos storage units, basketball, football and baseball sports cards holders, children's coloring boxes, and the like. A conventional display case for such items is illustrated in FIG. 2.

An object of this invention is to provide a multiple compartment storage case that meets the stowage requirements for a wide variety of articles such as those just exemplified.

One of the advantages is that the invention overcomes the problem of made-to-order storage boxes.

Another advantage is that the multiple compartment storage assembly herein can be adapted as a wall hanging.

A still further advantage of the invention is that the multiple compartment storage assembly can be used as a portable carrying case for the articles it houses.

These and other advantages will become apparent as the multiple compartment storage cases are described in detail.

SUMMARY OF THE INVENTION

The invention herein provides a multiple purpose compartmented storage assembly that can be adapted for use by artists for their supplies, by children for their articles, and by collectors for their collectibles. By the term "assembly" we intend a multiple compartment storage case which can be assembled by the user to meet his size requirements. The multiple compartment stowage case of this invention includes a rectangular frame attached to a back piece, and compartments within said frame defined by divider panels. That stowage case is improved herein by divider panels of various sizes which are adapted to be detachably inserted within the rectangular frame. The divider panels can be adjusted so as to define compartment sizes that accept variously sized articles, and means are provided for locking the connected divider panels in place to form those compartment sizes.

DETAILED DESCRIPTION OF THE INVENTION

As the invention is described it will become apparent that a number of adaptations of it are possible. For a better understanding of these variant forms, the invention will be described in conjunction with drawings of the adaptations.

DESCRIPTION OF THE DRAWINGS

FIG. 1 is a perspective view of a conventional shadowbox.

FIG. 2 shows a shadowbox which houses items of different sizes and shapes.

FIG. 3 illustrates side and end views of miniature compartment divider panels.

FIG. 4 shows elevation views of three types of connector strips used in conjunction with the miniature divider panels.

FIG. 5 depicts cross-sectional views taken through I—I, II—II, and III—III of the three connector strips of FIG. 4.

FIGS. 20 and 21 show the adaptation of the multiple compartment stowage case for sports card collections.

FIGS. 22*a* and *b* and FIGS. 23*a, d*, and *c* show how the sports cards are inserted in the front piece or cover of a multiple compartment stowage case.

FIG. 26 shows still another means for displaying collectibles.

FIG. 27 shows a hinge means for the multiple compartment stowage case when it is preferred not to have a removable cover or front piece.

FIGS. 28 and 29*a* and *b* show means for hanging a multiple compartment stowage case on a wall.

DESCRIPTION OF EMBODIMENTS

Figure 6:
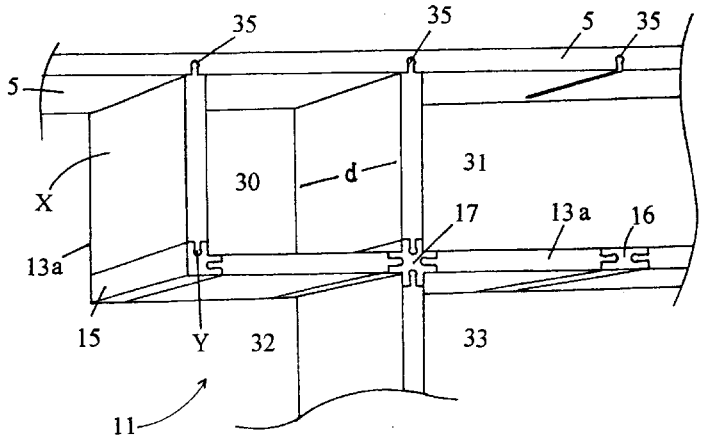
FIG. 6 is a back view showing how the connector strips hold the miniature panels in place in an assembly.

Referring first to FIG. 1, in this view a conventional shadowbox 1 is illustrated. As noted, it includes a back 3 and a frame 5 which surrounds a framework 7 forming a number of compartments 4 which house collectibles. Shadowboxes have a front cover of glass or plastic, not visible in FIG. 1, to protect the collectibles.

To illustrate the appearance of a shadowbox 1, a version 1 a is shown in FIG. 2 with collectibles 9 in some of the compartments. It is to be noted that not all of the collectible items 9 are the same size. The shadowbox illustrated in FIG. 1, thus, could not be used for these collectibles. A made-to-order shadowbox is called for. The need for special order shadowboxes is one of the disadvantages overcome by one of the embodiments of this invention.

FIGS. 3, 4, 5, 6, and 7 illustrate one compartment assembly means suitable for use in this invention. Other means can be employed since the means per se are not the essence of the invention. By the embodiment illustrated in FIGS. 3, 4, 5, 6, and 7 the framework 7 (FIG. 1) which houses the collectibles is essentially in kit form. The kit entails a tongue and groove assembly and includes miniature panels 13*a* whose side and end views are shown in FIG. 3, and connector strips 15, 16 and 17 illustrated in FIGS. 4 and 5.

Miniature panel 13*a* has a plane surface x and a tongue y, seen in the side view of FIG. 3, and, in part, in FIG. 6. The compartments are erected by using these miniature panels 13*a* and connector strips 15, 16 and 17 illustrated in FIGS. 4 and 5. The connector strips 15, 16, and 17 can best be visualized by comparing the elevation views of the connector strips in FIG. 4 with their corresponding cross-sections shown in FIG. 5, taken through I—I, II—II, and III—III. respectively of FIG. 4. The lengths of the connector strips 15, 16 and 17 are equal to each other, and that dimension is equal to the depth of panels 13*a* and also the depth d of the shadowbox frame 5 seen in FIG. 6. It is to be appreciated that the depth d of the shadowbox frame is a variable depending upon the size of shadowbox desired. Thus if large objects are to be held, deeper compartments will be need, and hence panels of greater depth. This will become apparent during the assembly procedure that will now be described.

For an understanding of the erecting steps attention is directed to the cross-sectional views of the connector strips shown in FIG. 5. It is to be noted that 15 is a comer connector strip. That connector strip is provided with two perpendicular grooves 19 and 21. The grooves, of course, are sized to accept tongues y of miniature panels 13*a* (FIG. 3), enabling the comer connecting strip 15 to be installed as shown in FIG. 6.

Referring further to FIG. 5, it can be seen that connector strip 16 is provided with oppositely disposed grooves 22 and 23. Since it allows for the insertion of additional panels 13*a* as illustrated in FIG. 6, strip 16 is an extension connecting strip. If desired this connector strip can be dispensed with, or its use minimized, by the provision of miniature panels 13*a* of various lengths.

Connector strip 17 is an intersection connecting strip rendering it possible to join four panels at right angles. Connector strip 17 is provided with four grooves 25, 26, 27 and 28 ninety degrees apart and sized to accept tongues y of the miniature panels to form four chambers or compartments 30, 31, 32 and 33 as illustrated in FIG. 6.

It will be understood that to effect the fabrication of variously sized compartments by the tongue and groove means suggested herein, grooves 35 are spaced at various intervals along the inner surface of frame 5 which holds the assembly in a framework 11. Framework 11 can then be inserted in box 37 as shown as an exploded view in FIG. 8.

Figure 7:
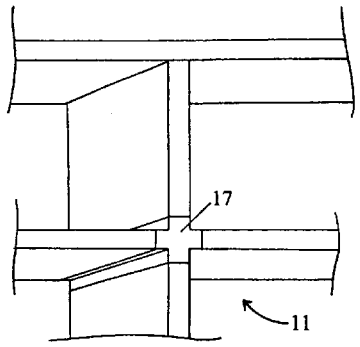
FIG. 7 is a front view of a portion of the assembly showing the appearance of the connections.

Referring now to FIG. 7, it can be seen that when the framework is thus formed the tongue and groove arrangement is not visible from the front of the shadowbox. Rather, the connector strips defining the chambers or compartments appear as does connector 17 in FIG. 7. As shown in FIG. 4 the grooves, 19 and 28 being examples, do not extend the full length of a connector strip (15 and 17), leaving an area A that is not grooved at the ends of the connector strips. Referring again to FIG. 3, the tongue y also does not extend across miniature panel 13*a*, but stops short a distance A from the panel edge. This allows the miniature panel and the connector to fit together as shown at 17 in FIG. 7.

Figure 8:
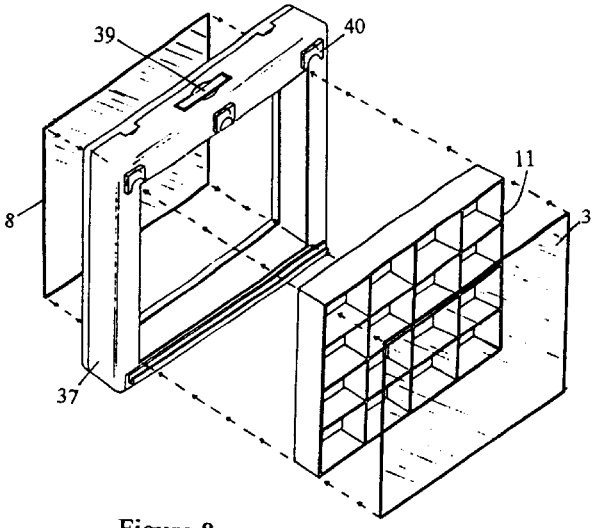
FIG. 8 is an exploded view of a completed shadowbox.
Figure 9:
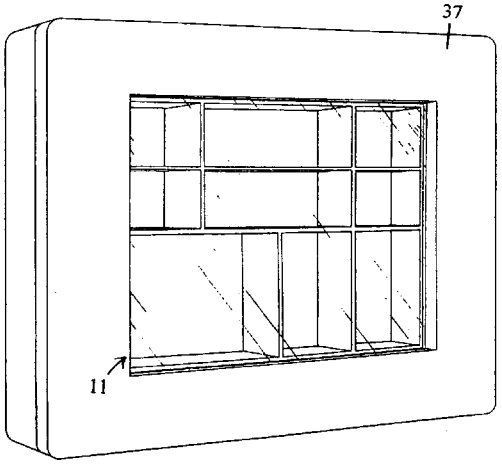
FIG. 9 is a front view of a multiple compartment stowage case of the invention.

FIG. 8 also shows the back 3 of the shadowbox, as well as the glass or plastic front cover 8 specified in connection with FIG. 1. As shown in FIG. 8, the shadowbox can also be provided with a handle 39 for carrying the collectibles elsewhere to shown them, and a special hanging means 40, to be described hereinafter, for locking the shadowbox in place when it is hung on a wall. A front view of a shadowbox 37, including a framework 11 of differently sized compartments, allowing for variously sized collectibles is illustrated in FIG. 9.

Shadowboxes are indeed widely used, particularly as wall hangings displaying the collected objects. By an aspect of this invention, however, even more desirable multiple compartment stowage cases are provided. They will be preferred because they more closely resemble framed pictures such as does stowage case 45 illustrated in FIG. 10. An examination of FIG. 10 raises the question, where are the collectibles? The answer is that in this embodiment they are stored within frame 46. This means, as will be shown in other drawings, that an advantage of such stowage cases is that stored articles such as art supplies and children's crayons, which are not collectibles, can be hidden. The artist or child can paint of color the picture (47) in the frame.

Figure 11:
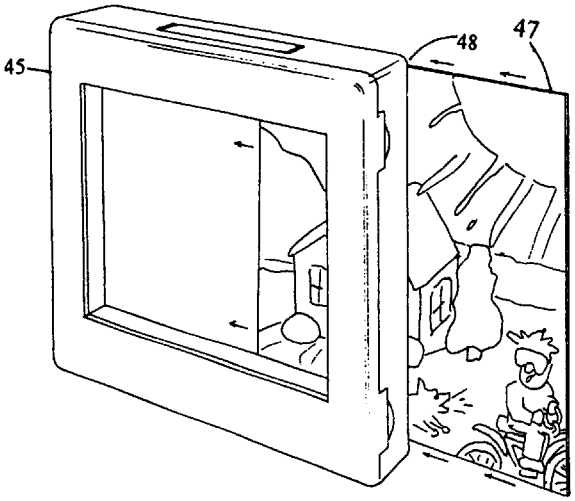
FIG. 11 illustrates the insertion of a picture in the multiple compartment stowage case of FIG. 10.

It is to be emphasized that articles can still be displayed when they are collectibles. However, the artwork aspect of the invention will first be discussed. The picture 47 can be in the form of a photograph, a sketch, a painting, or a copy, such as a limited edition of a painting, and the like. The picture can be inserted in a slot 48 in stowage case 45 as illustrated in FIG. 11, or it can rest on a ledge or shoulder under the glass cover within the stowage case as will be noted hereinafter.

Figure 10:
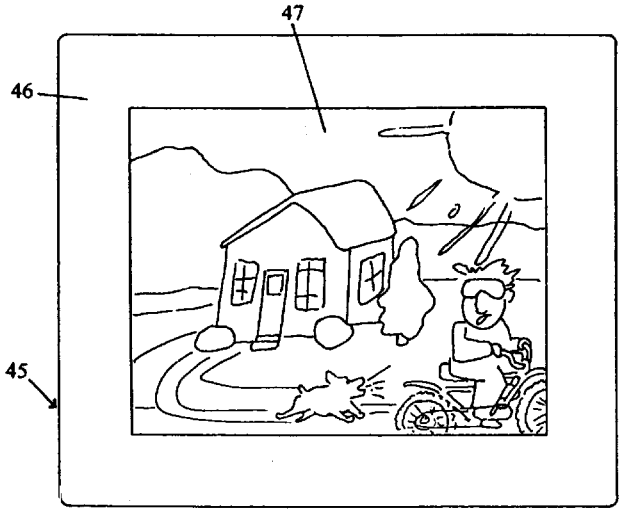
FIG. 10 shows a picture-type multiple compartment stowage case.

Considering now the details of the picture-type multiple compartment stowage cases, two embodiments of them are provided herein in addition to that illustrated in FIG. 10. In the modification shown in FIG. 10 the contents, as indicated, are not visible. In that embodiment the multiple compartment stowage case can be used to house non-display items such as the art supplies to be described in conjunction with FIG. 18.

Figure 12:
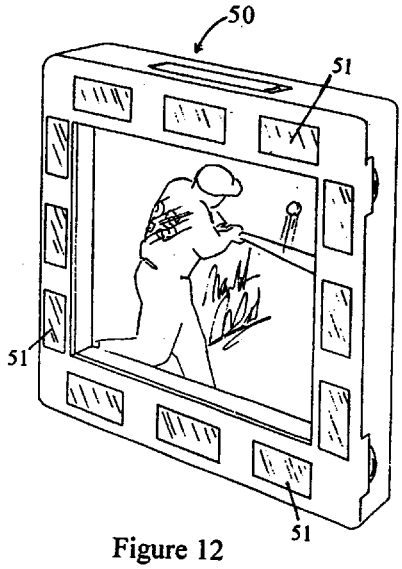
FIGS. 12 and 13 illustrate a different embodiment of the invention.
Figure 13:
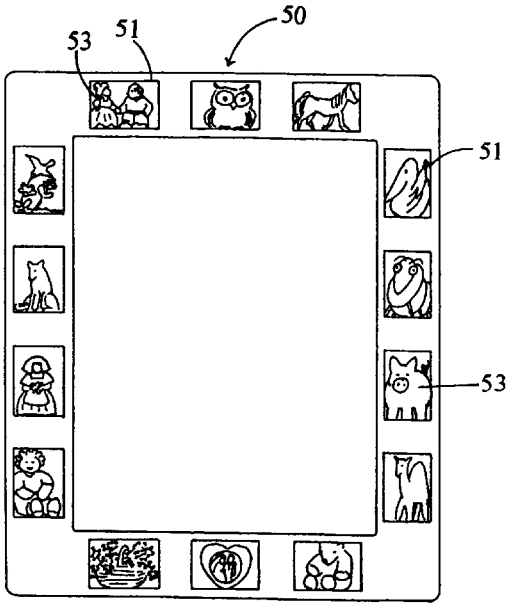

The second embodiment of the invention is illustrated in FIG. 12. It can be seen that multiple marginal windows 51 are included in the multiple compartment stowage case 50 through which collectibles 53 can be seen as shown in FIG. 13. There are three or four separate windows 51 along the side, top and bottom margins of the stowage case 50. The inside view of multiple compartment stowage case 50, showing compartments 54, is shown in FIG. 14.

Figure 15:
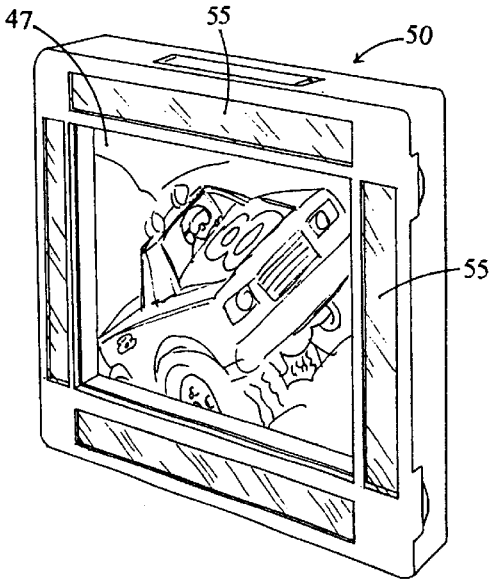
FIGS. 15 and 16 illustrate a slightly different embodiment of the invention.

A third representation of the multiple compartment stowage case embodied herein is shown in FIG. 15. In this embodiment the multiple compartment stowage case 50 is fabricated with single windows 55 along each side and the top and bottom, in other words along the four margins of the stowage case. The open (isometric) view of this multiple compartment stowage case illustrated in FIG. 16 which shows the single windows 55 and compartments 54. Also illustrated is front window 44 to be discussed shortly. The multiple compartment stowage case 50 with collected items 56 housed in its compartments is depicted in FIG. 17.

Figure 14:
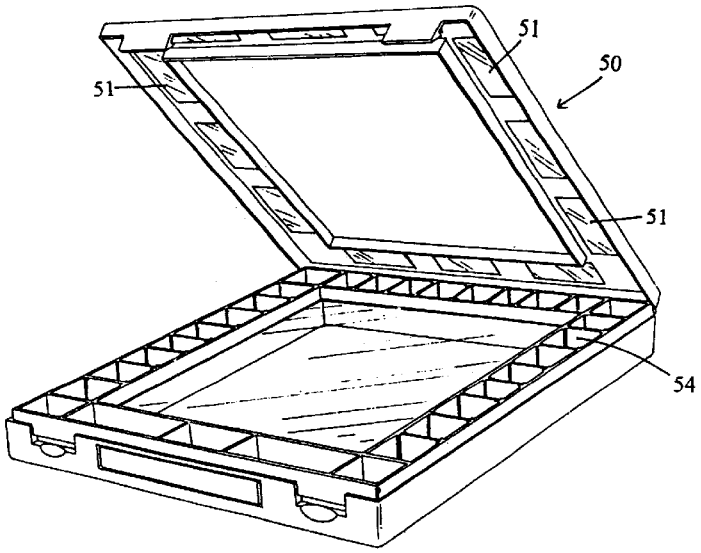
FIG. 14 is a perspective view showing the open multiple compartment stowage case of FIGS. 12 and 13.
Figure 16:
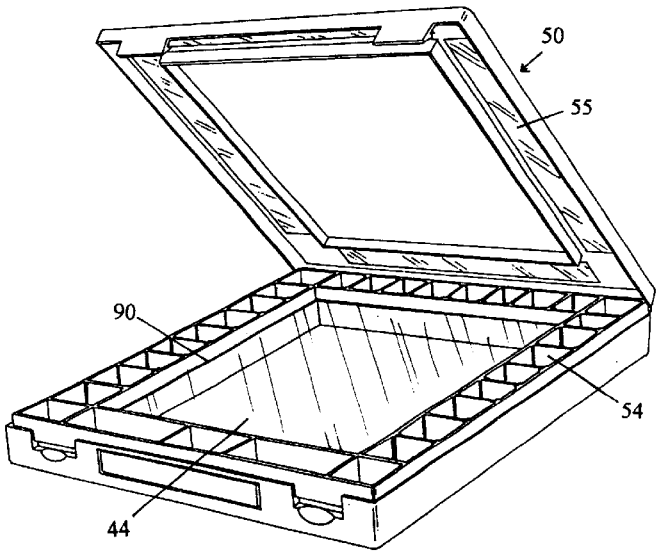
Figure 17:
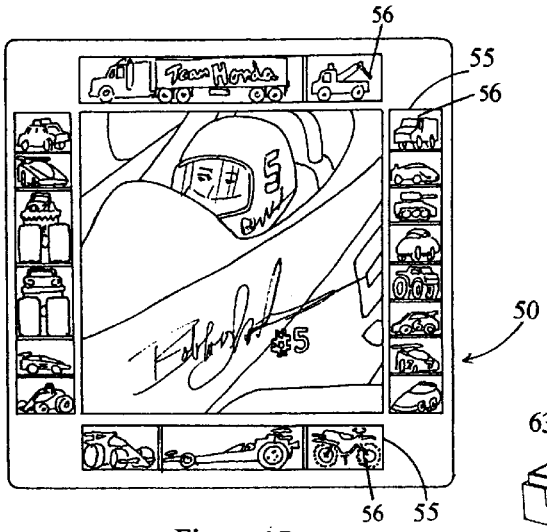
FIG. 17 illustrates the appearance of the multiple compartment stowage case of FIGS. 15 and 16 with the collectibles therein.
Figure 18:
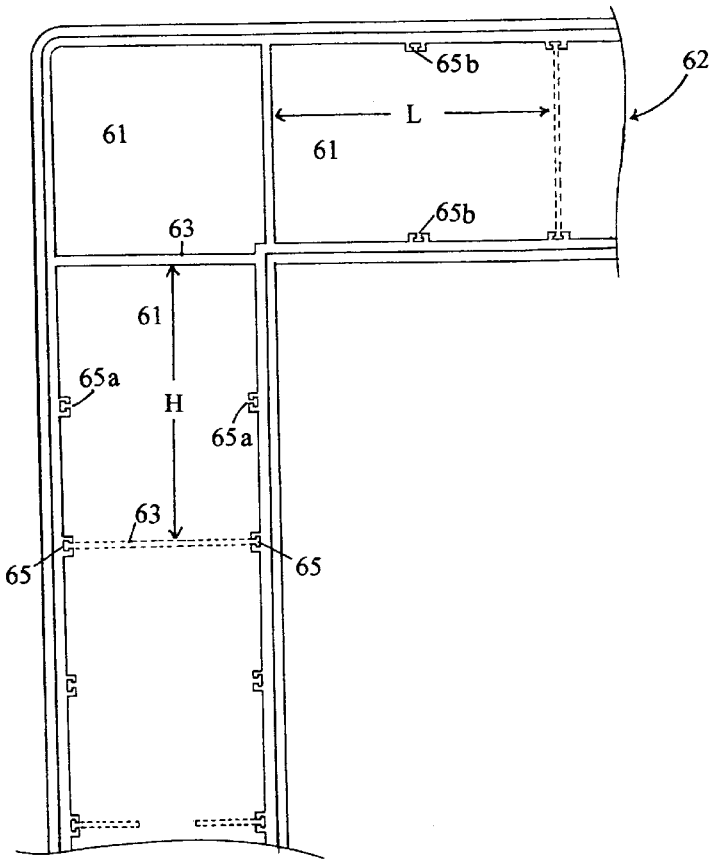

The fabrication of the various storage compartments 54 (FIGS. 14 and 16 can best be described in conjunction with FIG. 18 in which the top view of a segment of a framework 62 is illustrated. Compartments 61 are constructed by the insertion of panel strips 63 in grooves such as 65 formed in the side walls of the framework as explained in describing the construction of the shadowbox. The length of each panel 63 is equal to the width (side compartments), or height (top and bottom compartments) of the various compartments 61 so that they fit as shown in FIG. 18. The horizontal length L, and the vertical height H are determined by the grooves 65 utilized. Thus if side grooves are not utilized, such as 65*a*, side compartments 61 will be higher as shown at H. Similarly, if top or bottom grooves, such as 65*b*, are not used those compartments 61 will be longer or wider as shown at L.

Figure 19:
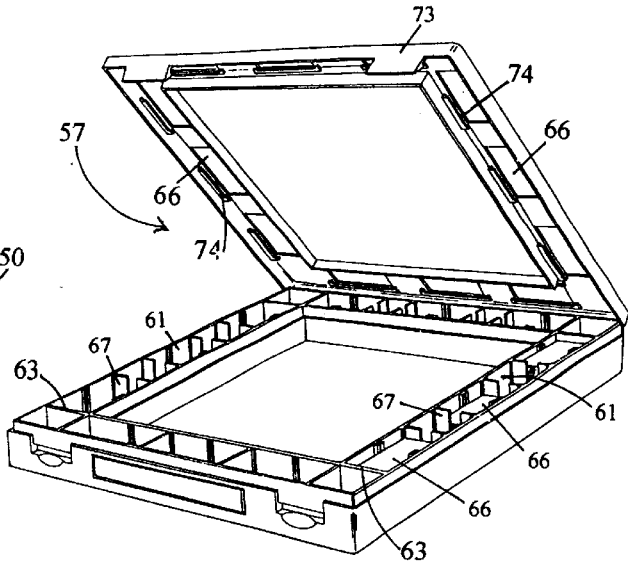
FIGS. 18 and 19 illustrate the fabrication of the multiple compartment stowage cases.

A multiple compartment stowage case 57 for sports card collections is illustrated in FIG. 19. When baseball or football or other cards are the collected items, panels 67 (FIG. 20), which are shorter than panels 63, can be used. This is apparent in FIG. 19 which shows the compartments 61. By shorter is meant less than the width of side or the height of top and bottom compartments as seen in FIG. 21. Shorter panels 67 are compared with normal panels 63 in FIG. 20, which, below, also shows top views of the two panels as 63*a* and 67*a*. Referring back to FIG. 19, panels 63 extend across compartments 61 whereas fingers can be inserted between shorter panels 67 to remove more easily the cards 66. In addition, as will be explained shortly shorter panels 67 will allow the user to insert paintbrushes, pencils or crayons in the compartments when it is used as an art box.

Sports card collections 66 can be displayed in the compartments as are other collectibles. However many collectors will prefer to insert their favorites in the front piece or cover (lid) 73 (FIG. 20) of the multiple compartment stowage case so that the display will resemble that illustrated in FIG. 21. To this end cards 66 are slipped into grooves 74 provided, one on each side, along the sides of their windows. These windows 51 and the grooves 74 are shown in FIGS. 22*a* and 22*b*, and in FIGS. 23*a*, 23*b*, and 23*c*.

FIG. 22*a* shows windows 51 and grooves 74 prior to the insertion of, say, baseball cards. An end view of a groove 74 is shown in FIG. 22*b* which is a cross section taken through IV—IV of FIG. 22*a*. The insertion of sports cards 66 in grooves 74 is illustrated in the remaining figures. In FIG. 23*a* baseball card 66 is only partially inserted in grooves 74 and separate window 51 is partially visible. FIG. 23*b* shows the baseball card 66 fully inserted behind the window of in the cover or lid 73 of a multiple compartment stowage case. FIG. 23*c* shows the partial insertion of a baseball card 66 behind a side window 51 in the stowage case cover. It is to be noted that since this is a side panel a stop 72 is provided at the end of groove 74 to prevent the card from being drawn through the groove by the force of gravity. The grooves in FIG. 23*c* thus differ from those in FIGS. 23*a* and 23*b*.

Figure 24:
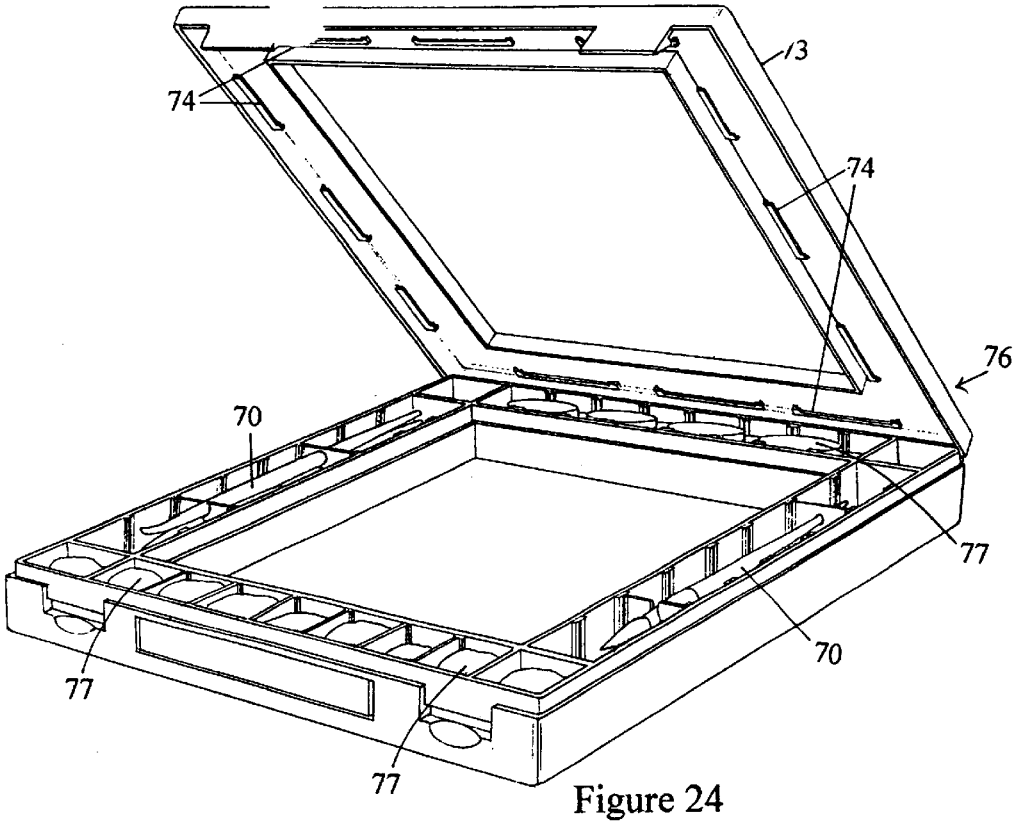
FIG. 24 illustrates the use of the multiple compartment stowage case as an artist's case.
Figure 25A:
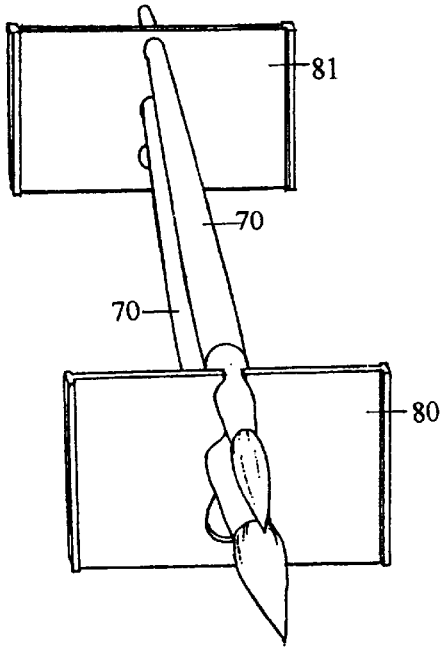
FIGS. 25*a* and *b* illustrate special miniature panels for holding paintbrushes in the artist's case.
Figure 25B:
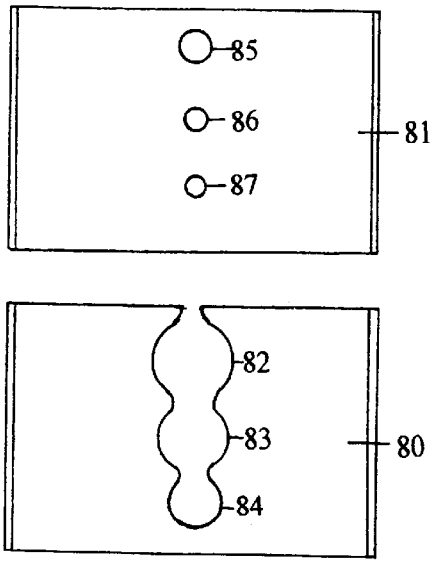

It has been stated that shorter panels 67 permit storage of longer objects that are in use rather than being collected, and that these are stowed in the windowless multiple compartment stowage case described in FIGS. 10 and 11. An example of this embodiment is art box or artist's carrying case 76 shown in FIG. 24. FIG. 24 shows paintbrushes 70 on each side of multiple compartment stowage case 76. Art supplies 77 can be seen in other compartments of the art box. Paintbrushes 70 could be placed loosely in the art box between shorter panels (67, FIG. 19). However, they are best carried in retainers or stirrups 80 and 81 illustrated in FIGS. 26*a* and 26*b*. Retainer 80 is provided with three sizes of openings 82, 83 and 84 adapted to accept three sizes of paintbrushes, with the larger brush fitting in the largest opening 82, etc. The tips of the brush handles are inserted in corresponding holes 85, 86 and 87 in retainer 81. Needless to say, the retaining panels or stirrups 80 and 81 are locked in grooves such as 65 shown in FIG. 18.

Figure 20:
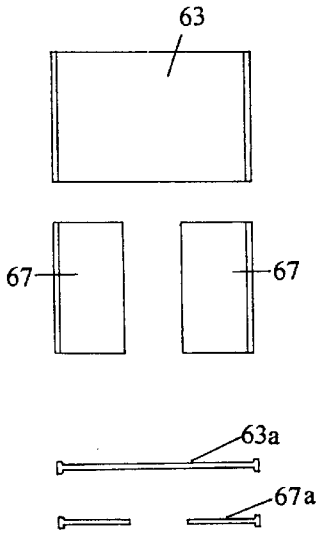

It has been pointed out that instead of inserting a picture in a slot in the back of the multiple compartment stowage case it can be rested on a ledge beneath the glass front. This ledge 90 can be seen in FIG. 16. Such variations and ramifications of the invention will occur to those skilled in the art in the light of the foregoing description thereof. As an example, three stowage case lids can be provided with the basic unit, or a single lid with inserts can be furnished. The inserts can be opaque panels, larger windows, or smaller windows installed in the marginal areas of the multiple compartment stowage case frontpiece. Each marginal opening is adapted to enable the user to insert a panel or window to form one of the embodiments of the invention. By such means one stowage case lid can be provided for all three embodiments previously described. In this connection FIGS. 19 and 20 show sports cards in grooves 74. It will be appreciated that the cards can be stored in a multiple compartment stowage case without windows if they are not to be visible. Another variation is illustrated in FIG. 26. Since most multiple compartment stowage case are used as wall hangings it may be desirable to suspend the collectible 88 in the compartment in the shadowbox or multiple compartment stowage case. It has also been pointed out that the multiple compartment stowage case cover 73 can be removable or attached to the case. FIG. 27 shows a multiple compartment stowage case 1 provided with a hinge 89 to that it can be swung open as are briefcases and other luggage.

In addition to handle 39 signified in connection with FIG. 8, hanging means can be provided for mounting the multiple compartment stowage case on a wall. FIG. 28 shows a wall 94 carrying a screw or nail 91 which fits into eye 92 or hanging clip 93 of the multiple compartment stowage case (50). A preferred hanging means is the subject of my patent U.S. Pat. No. 5,878,694. This hanging means is illustrated in FIG. 28*a* and FIG. 28*b*. Referring to those figures, it can be imagined that if support bar 95 is attached to a wall of a room, the multiple compartment stowage case (50) can be placed over it with the cavities in socket components 96 which fit over lobes 98 on support bar 95 so that the lobes seat in the cavities or shallow recesses in the socket components. For locking purposes the lobes and sockets will be tapered as shown in FIGS. 28*a* and 28*b*. In other words, rather than lobes having top portions perpendicular to the wall they have upwardly directed portions clearly visible in the figures. In order to remove the stowage or display case from the hanging bar, from the lobes, then, it must be lifted upwardly rather than merely outwardly. This action affords a means for locking the multiple compartment stowage case on the wall. When a panel or a mounted picture is slid into upper and lower grooves, lower grooves 99 being visible in FIG. 28*a*, that panel prevents the multiple compartment display case from being lifted off of the lobes. The strength of the lock then will depend on the strengths of the support and picture panel. These and other modifications within the scope of this invention will occur to those skilled in the art.

What is claimed is:

1. In a multiple compartment stowage case having storage compartments therein defined by insertable divider panels and a transparent front cover over those compartments, the improvement wherein the storage compartments are spaced marginally along all sides in the case forming a larger center storage compartment in the center thereof, wherein the front cover includes transparent windows marginally disposed above marginally spaced storage compartments to expose collectibles in the compartments, and a transparent window above the larger center storage compartment and wherein the back piece is provided with means for holding a picture behind the center window over the larger storage compartment in the center of the stowage case.

2. The multiple compartment stowage case of claim 1 wherein the back piece is provided with slot means adapted to hold a picture behind the center window over the larger compartment in the center of the stowage case.

3. The multiple compartment stowage case of claim 1 wherein the back piece beneath the front cover is provided with a ledge adapted to hold a picture behind the center window over the larger compartment in the center of the stowage case.

4. The multiple compartment stowage case of claim 1 wherein the storage compartments spaced marginally along the sides of the case are sized to house collections of collectible cards, and wherein the transparent front cover forms a window over the top card.

5. The multiple compartment stowage case of claim 4 wherein front cover includes slot means for receiving and holding a card above each compartment, concealing the card collection within the compartment.

6. The multiple compartment stowage case of claim 5 wherein a gap means along one side of each marginally spaced compartment forms an opening permitting collectible cards to be readily removed.

7. The multiple compartment stowage case of claim 1 wherein the transparent front cover includes a marginally opaque area concealing contents in the compartments spaced marginally within said rectangular frame, and wherein the stowage case includes a means for inserting and retaining a picture over the larger center storage compartment to simulate a picture in a frame.

8. The multiple compartment stowage case of claim 7 wherein the marginally spaced storage compartments are adapted to hold art supplies in the nature of paints and paint brushes.

9. The multiple compartment stowage case of claim 7 wherein a lid is releasably hinged on one side and provided with a snap locking means on its opposite side.

10. A shadowbox in kit form, the kit including (a) a rectangular frame of a given depth, (b) a back piece adapted to be attached to the frame, (c) miniature panels of various lengths having depths along their side edges equal to the depth of the shadowbox frame, and (d) connector strips whose lengths are equal to the depth of the panels along the panel side edges, wherein the miniature panels have tongues formed along their side edges, wherein the connector strips have grooves formed along their lengths to receive the tongues to effect, by tongue and groove means, the fabrication of variously sized compartments to be inserted in the frame to house variously sized collectibles, and wherein the grooves do not extend the full lengths of the connector strips, and the tongues formed along side edges of the miniature panels do not extend the full length across the panel edges, allowing miniature panels and connector strips to fit together so that the tongue and groove fabrication is not visible from the front of the shadowbox.

11. The shadowbox kit of claim 10 wherein the kit includes a transparent cover.

* * * * *